US007121434B1

(12) United States Patent
Caruso

(10) Patent No.: US 7,121,434 B1
(45) Date of Patent: Oct. 17, 2006

(54) ACTUATOR FOR AEROSOL CONTAINER

(75) Inventor: Albert P. Caruso, Tonawanda, NY (US)

(73) Assignee: The GPM Group LLC, North Tonawanda, NY (US)

( * ) Notice: Subject to any disclaimer, the term of this patent is extended or adjusted under 35 U.S.C. 154(b) by 168 days.

(21) Appl. No.: 10/710,752

(22) Filed: Jul. 30, 2004

(51) Int. Cl.
*B65D 83/16* (2006.01)

(52) U.S. Cl. ..... 222/402.13; 222/402.15

(58) Field of Classification Search ..... 222/402.1, 222/402.13, 402.15
See application file for complete search history.

(56) References Cited

U.S. PATENT DOCUMENTS

| | | | | |
|---|---|---|---|---|
| 3,225,966 | A | 12/1965 | Sagarin | |
| 3,620,425 | A | 11/1971 | Rait | |
| 3,762,611 | A | 10/1973 | Nigro | |
| 3,764,044 | A | 10/1973 | Pajak | |
| 3,934,761 | A | 1/1976 | Gentreau | |
| 4,011,970 | A | 3/1977 | Crowle et al. | |
| 4,024,995 | A | 5/1977 | Landen et al. | |
| 4,065,036 | A | 12/1977 | Kirk, Jr. | |
| 4,095,725 | A | 6/1978 | Goncalves | |
| 4,582,228 | A | 4/1986 | Diamond et al. | |
| 4,620,646 | A | 11/1986 | Crapser | |
| 4,641,644 | A | 2/1987 | Andersson et al. | |
| 5,203,478 | A | 4/1993 | de Laforcade et al. | |
| 5,287,998 | A | 2/1994 | Smrt | |
| 5,411,184 | A | 5/1995 | Smrt | |
| 5,649,645 | A * | 7/1997 | Demarest et al. | 222/153.07 |
| 6,065,474 | A | 5/2000 | Coe | |
| 2003/0127468 | A1 | 7/2003 | Lohgman-Adham et al. | |
| 2005/0133542 | A1 * | 6/2005 | Kolanus | 222/402.13 |
| 2005/0230437 | A1 * | 10/2005 | Vlooswijk et al. | 222/402.15 |

* cited by examiner

*Primary Examiner*—Joseph A. Kaufman
(74) *Attorney, Agent, or Firm*—Simpson & Simpson, PLLC

(57) ABSTRACT

The present invention broadly comprises an actuator assembly for an aerosol container in which a collar is attached to the aerosol container and substantially encloses an actuator. The actuator is functionally attached to an aerosol valve and includes slots that contact a plurality of guide rails attached to the inner surface of the collar as well as a passage from the valve to a nozzle shaped opening. When the actuator is pushed down, the downward movement is controlled by the interaction of the slots with the guide rails. Also provided is a cover that guards against accidental force being applied to the actuator.

16 Claims, 3 Drawing Sheets

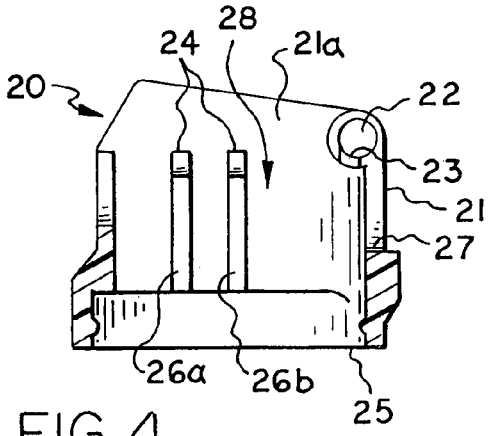
FIG. 4
FIG. 5
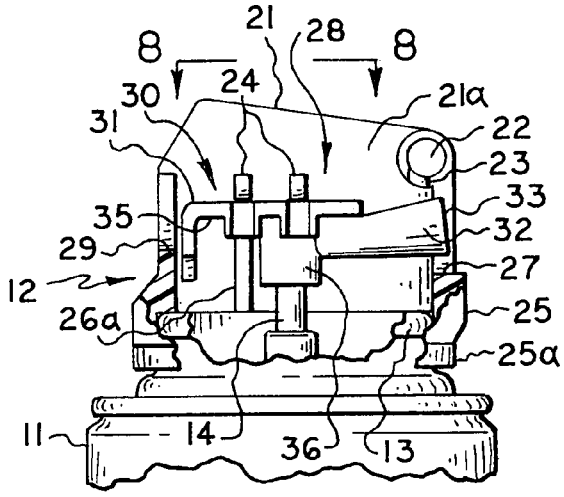
FIG. 8
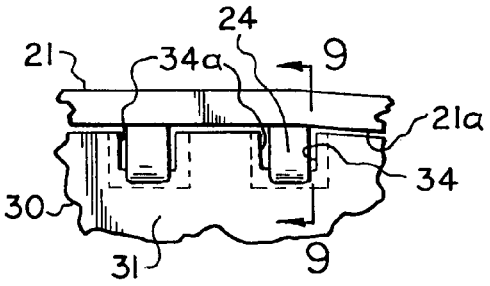
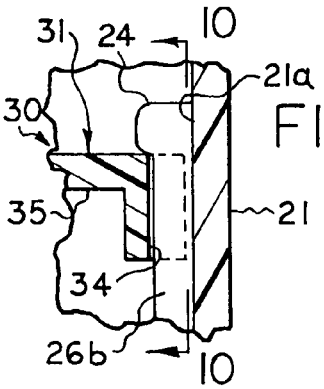
FIG. 9
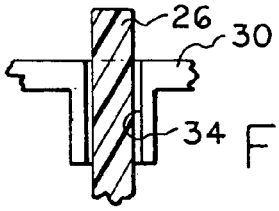
FIG. 10
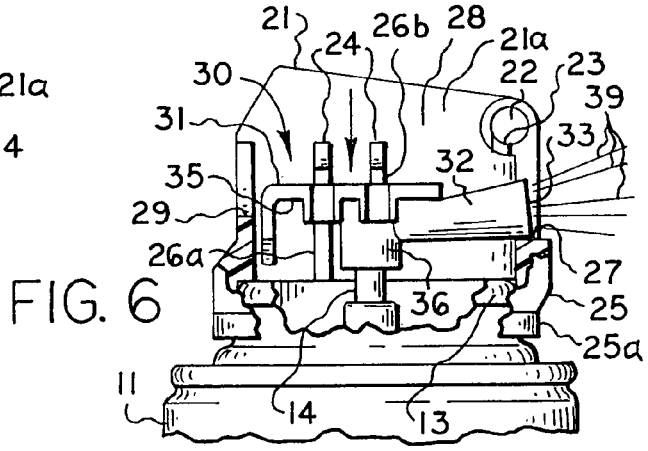
FIG. 6
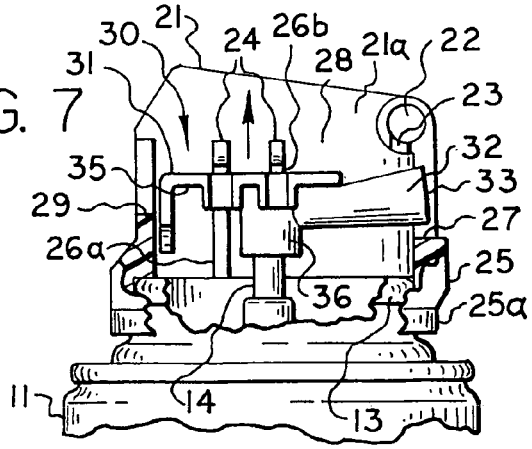
FIG. 7

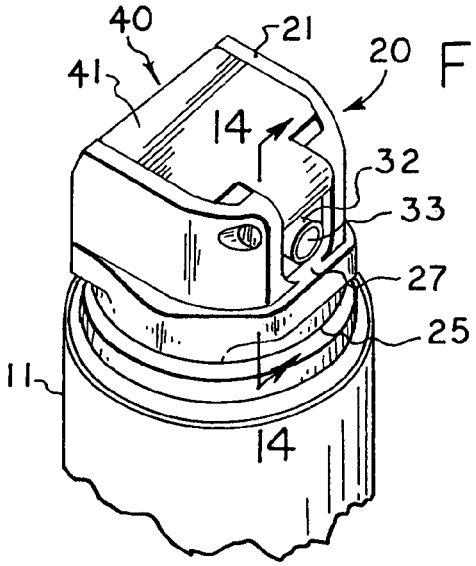
FIG. 11
FIG. 12
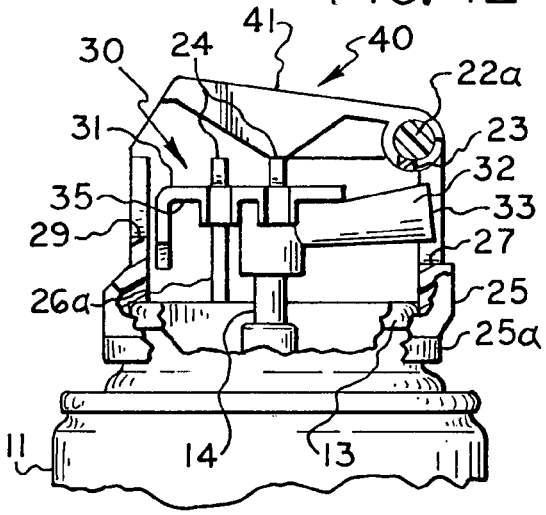
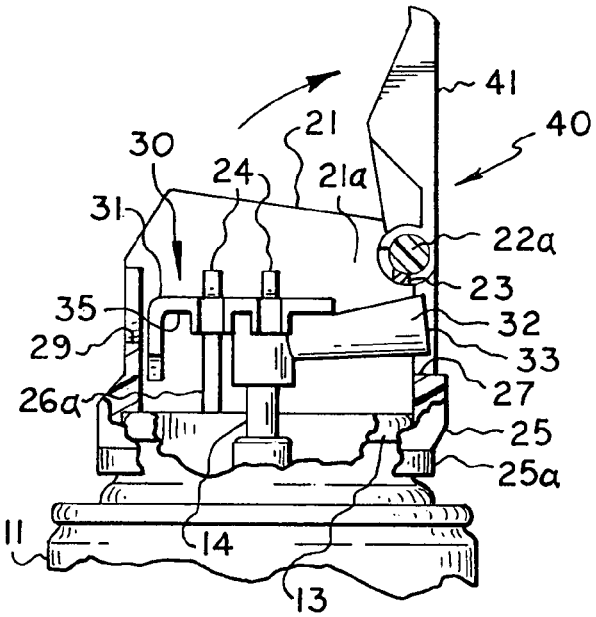
FIG. 13
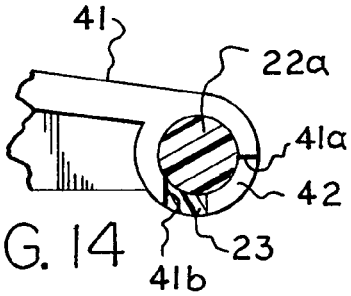
FIG. 14
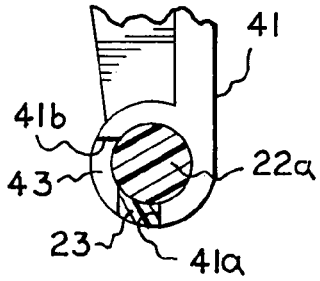
FIG. 15

ACTUATOR FOR AEROSOL CONTAINER

FIELD OF THE INVENTION

The present invention relates generally to aerosol containers, specifically to delivery systems for the content of aerosol containers, and more specifically to aerosol actuator systems.

BACKGROUND

The use of aerosol containers and delivery systems is widespread for both consumer and commercial products. Household products, such as furniture wax and oven cleaners, personal products such as hair sprays and topical burn medications, and commercial products such as insect repellants and paints use aerosol containers for storage and aerosol valves to deliver the contents to the desired target.

Several problems can arise during the use of aerosol container systems. One such problem is found in the aerosol valve itself. Aerosol valves are activated by depressing a valve along a stem that opens the valve and releases the contents that are stored under pressure. Very often, the pressure on the valve is not applied coaxially along the stem, but is applied at an angle. This angled pressure vector can cause bending or breaking of the stem or valve leading to leaks in the container and loss of contents.

Another problem is the potential loose fit of the aerosol actuator, the component that directly contacts the aerosol valve. It is important that the actuator not only be in secure contact with the aerosol valve, but also that the actuator stays oriented in the same direction to ensure that the contents of the container are released in the same direction each time.

Still another problem with aerosol containers is the potential for accidentally pressing on the valve to unexpectedly release the contents. If aerosol containers are kept in a confined space with other objects, such as a purse, it is relatively easy for the valve to be activated by other objects if it is not covered. Detachable covers are often used to correct this problem. However, detachable covers are easily misplaced, add to the overall size of the container, and are inconvenient to use in that they must be completely removed from the container before use and then securely placed back on the container after use.

What is needed then is an aerosol actuator that is configured to always be depressed coaxially with the aerosol valve stem, that will remain in the correct orientation in relation to the release direction of the contents, and that provides a convenient way to prevent accidental opening of the valve.

SUMMARY OF THE INVENTION

The invention broadly comprises an actuator assembly for an aerosol container comprising a collar having an interior surface and having attachment means for attachment to the aerosol container, at least one pair of guide rails projecting from the interior surface of the collar and an actuator comprising one or more slots in which at least one of the slots is in operative contact with one of the guide rails. The aerosol container has an aerosol valve from which the contents exit the container. Each of the guide rails comprises an end proximate to the aerosol valve and an end distal from the aerosol valve. Each one of the at least one pair of guide rails is positioned on a different side of the interior surface of the collar. At least one knob projects from the interior surface of the collar. Finally, the invention also includes an actuator comprising a plurality of slots, each one of the plurality of slots are in operative contact with one of the guide rails and comprising a passage having a first opening and a second opening, the first opening in functional connection with an aerosol valve on the aerosol can.

The invention also broadly comprises an actuator assembly for an aerosol container comprising a collar having an interior surface and having attachment means for attachment to the aerosol container, at least one pair of guide rails projecting from the interior surface of the collar and an actuator comprising one or more slots in which at least one of the slots is in operative contact with one of the guide rails. In rotational attachment to the collar is a flip cover that substantially covers an actuator and restricts access to the actuator when in the covering position. The aerosol container has an aerosol valve from which the contents exit the container. Each of the guide rails comprises an end proximate to the aerosol valve and an end distal from the aerosol valve. Each one of the at least one pair of guide rails is positioned on a different side of the interior surface of the collar. At least one knob projects from the interior surface of the collar. Finally, the invention also includes an actuator comprising a plurality of slots, each one of the plurality of slots are in operative contact with one of the guide rails and a passage having a first opening and a second opening, the first opening in functional connection with an aerosol valve on the aerosol can.

A general objective of the invention is to provide an aerosol actuator that reliably releases the contents of an aerosol container.

A second objective of the present invention is to make available an actuator guide system to enable consistent movement of an actuator when pressure is applied to the actuator from different directions An additional objective of the invention is to disclose an aerosol actuator assembly that prevents wear on an aerosol valve caused by offset pressure applied to the valve.

A further objective of the invention is to provide a cover to reduce the potential for accidental release of the contents of an aerosol container.

A still further objective of the present invention is to present an aerosol actuator assembly configured to prevent the actuator from bursting off an aerosol valve.

An additional objective is to make available an aerosol actuator that applies pressure along the axis of an aerosol valve.

BRIEF DESCRIPTION OF THE SEVERAL VIEWS OF THE DRAWINGS

The nature and mode of operation of the present invention will now be more fully described in the following detailed description of the invention taken with the accompanying drawing figures, in which:

FIG. 4 is a cross-section of the collar of the actuator assembly taken along line 4—4 in FIG. 2;

FIG. 5 is a cut-away side view of the aerosol actuator of the present invention in which the aerosol valve is in the closed position and the actuator is pressed against knobs projecting from a pair of guide rails;

FIG. 6 is a cut-away side view of the aerosol actuator assembly of the present invention in which the contents of the aerosol container are released as the actuator is moved down from the restraining knobs;

FIG. 7 is a cut-away side view of the aerosol actuator assembly of the present invention in which the actuator is depicted as moving up toward the restraining knobs to shut of the release of the container contents;

FIG. 8 is a top view of the actuator pressed against the restraining knobs on the guide rails taken along line 8—8 in FIG. 5;

FIG. 9 is a cross-section view taken along line 9—9 of FIG. 8 depicting the actuator pressed against the restraining knobs in which the knobs are shown projecting from the interior surface of the collar;

FIG. 10 is a sectional view taken along line 10—10 in FIG. 9 demonstrating a slot of the actuator positioned around the guide rail situated on an interior surface of the collar;

FIG. 11 is a top perspective view of an alternate embodiment of the present invention depicting the flip cover in closed position over the actuator;

FIG. 12 is a cut-away side view of the actuator assembly of the present invention showing the flip cover in the closed position over the actuator;

FIG. 13 is the same view as that of FIG. 12 depicting the flip cover in the open position;

FIG. 14 is a close-up view of the rotary attachment of the flip cover to the collar of the actuator assembly in the closed position; and FIG. 15 is a close-up view of the rotary attachment of the flip cover to the collar of the actuator assembly in the open position.

DETAILED DESCRIPTION OF THE INVENTION

At the outset, it should be appreciated that like drawing numbers on different drawing views identify identical structural elements of the invention. While the present invention is described with respect to what is presently considered to be the preferred embodiments, it is understood that the invention is not limited to the disclosed embodiments.

Figure 1:
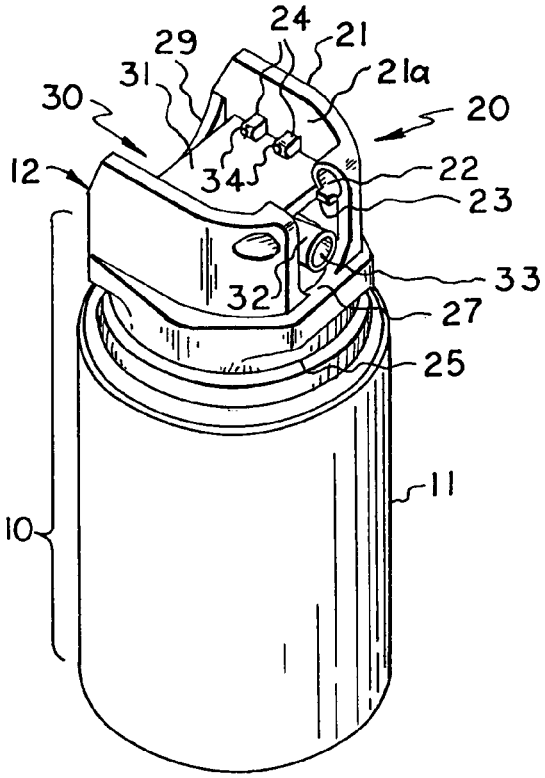
FIG. 1 is a top perspective view of the actuator assembly of the present invention attached to an aerosol container.

The present invention broadly comprises an aerosol container actuator assembly having a collar attached to the aerosol container that provides a surrounding wall for an aerosol actuator. FIG. 1 is a top perspective view of the combination actuator assembly-container 10. Actuator assembly 12 is shown attached to container 11. Wall 21 of collar 20 partially surrounds actuator 30 on three sides. Persons skilled in the art will recognize that collar 20 may have several different shapes as long as access to actuator 30 by an operator is retained. Knobs 24 are seen projecting from interior surface 21*a* of wall 21. Receiver 22 is defined by wall 21. Shoulder stop 23 is in close proximity with receiver 22. In the preferred embodiment shown, shoulder stop 23 is integral with receiver 22 and wall 21. Not shown is a second receiver on the opposite wall transverse from visible receiver 22. Also not shown in FIG. 1, a second shoulder stop 23 is also present in close proximity to the second receiver. At least one knob 24 projects from inner surface 21*a*. As will be explained below, knob 24 acts to restrict the upward movement of actuator 30 to maintain the integrity of actuator assembly 12 by preventing the pressure of the aerosol contents from propelling actuator 30 off actuator assembly 12. Opening 27 through wall 21 is provided to enable the contents of aerosol container 11 to be released to the immediate environment. Although opening 27 is depicted as U-shaped in FIG. 1 and subsequent figures, persons skilled in the art will recognize that opening 27 may possess any convenient shape. Collar 20 is configured with attachment means 25 to attach collar 20 to container 11. In one preferred embodiment, attachment means 25 comprises a bead that forms a crimp-type grip to attach collar 20 to container 11. Orifice 28 seen in FIG. 2 is defined by attachment 25 and wall 21 which either together or separately bound the bottom perimeter of collar 20.

The sides of actuator 30 are shown as comprising slots 34. Nozzle 32 of actuator 30 is shown extending from opening 27 and defines nozzle orifice 33.

Figure 2:
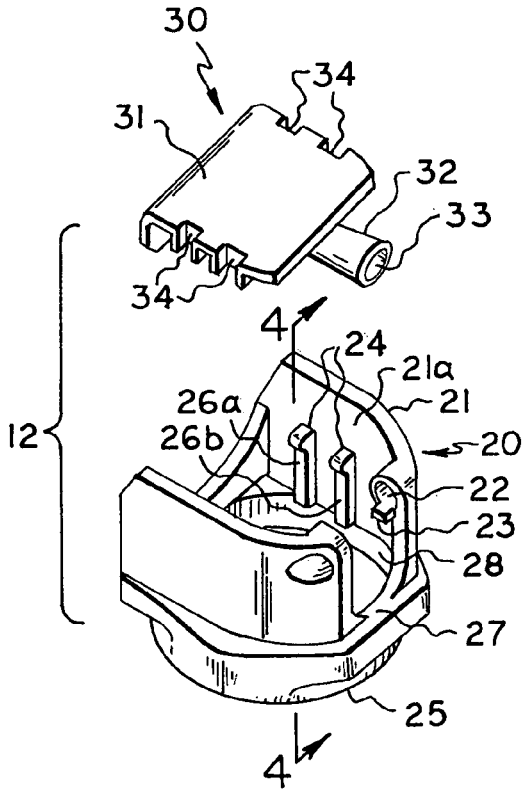
FIG. 2 is an exploded top perspective view of the actuator assembly of the present invention.

FIG. 2 is an exploded top perspective view of actuator assembly 12. Slots 34 of actuator 30 are clearly shown on opposite sides of actuator 30. In the preferred embodiment shown, slots 34 are configured as channels to contact and traverse guide rails 26 on collar 20, as described below. A plurality of guide rails 26 extend along inner surface 21*a* of collar wall 21 with at least one of guide rails 26 on a different side of inner surface 21*a*. In a preferred embodiment, at least one pair of guide rails 26 is provided with each of the pair of guide rails placed on different areas of inner surface 21*a* so as to face different directions. In a more preferred embodiment, each of the pair of guide rails are positioned on opposite areas of inner surface 21*a* so as to face each other. Thus, one of guide rail pair 26*a* is shown on one area of inner surface 21*a*. The other of guide rail pair 26*a* (not shown) is preferably positioned across from guide rail 26*a*. Similarly, one of guide rail pair 26*b* is shown in approximately the same area or region of inner surface 21*a* as visible guide rail 26*a*. Again, a second guide rail 26*b* is preferably positioned across from guide rail 26*b* on inner surface 21*a*. Although it is preferred that the individual guide rails in each pair be positioned on opposite sides of inner surface 21*a*, the separate guide rails 26 in each pair may be positioned differently as warranted by the particular configuration of actuator assembly 12.

FIG. 2 depicts a preferred embodiment in which knobs 24 are integral with guide rails 26. In an alternate embodiment, knobs 24 may be detached from guide rails 26 provided knobs 24 extend from inner surface 21*a* sufficiently to restrict the upward movement of actuator 30. (See below.) Preferably, actuator 30 is configured so that the shape and size of its perimeter is only slightly smaller that the shape and size of inner surface 21*a* so as to create a close fit between actuator 30 and inner surface 21*a* that still allows smooth movement of actuator along guide rails 26.

Figure 3:
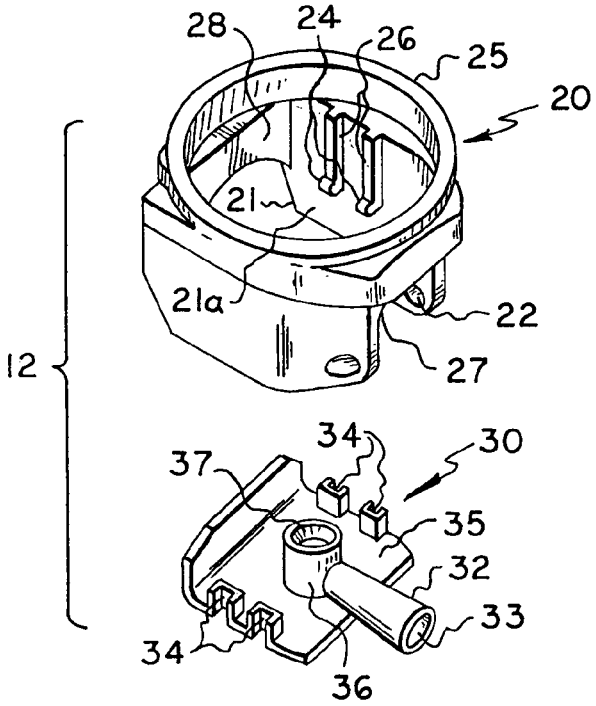
FIG. 3 is an exploded bottom view of the actuator assembly of the present invention.

FIG. 3 depicts an exploded bottom perspective view of actuator assembly 12. Fitting 36 is shown attached to bottom surface 35 and surrounds aperture 37. Aperture 37 and nozzle orifice 33 are connected to form a continuous passage.

FIG. 4 is a cross-section through U-shaped opening 27 of collar 20 taken along line 4—4 in FIG. 2. One member each of guide rail pairs 26*a* and 26*b* are seen extending substantially parallel to each other in a vertical direction. By vertical is meant approximately perpendicular to the plane of the perimeter of attachment 25 of collar 20.

FIG. 5 is a cut-away side view with parts of wall 21 and actuator 30 removed to depict the attachment of actuator assembly 12 to container 11. Fitting 36 is mounted over aerosol valve 14. In one embodiment, fitting 36 is sized to provide a snug friction fit over valve 14. In an alternate embodiment, fitting 36 may be attached to valve 14 using adhesives, glue, welding or other methods well known to those skilled in the art. Aerosol valve 14 is constructed to release the contents of container 11 when depressed toward container 11 in a coaxial direction along valve 14. In the embodiment shown in FIG. 5, nozzle 32 is pitched at an angle between approximately 7–10° relative to bead 13 of container 11. At such an angle, self-defense aerosols such as MACE® and pepper spray discharge at an upward angle such that contents 39 are more likely to contact an attacker's face rather than his/hers chest or waist. In an alternate embodiment, nozzle 32 may be at substantially a zero angle, meaning parallel to the plane of bead 13 of container 11 or at a downward angle. Top surface 31 of actuator 30 is seen contacting knobs 24 which again are seen integral with guide rails 26. Attachment 25, including lower portion 25*a*, is shown contacting bead 13 of container 11 to form a friction fit to hold actuator assembly 12 onto container 11. Nozzle 32 may be bell shaped as shown in FIG. 2, tapered, or other suitable shape Using the same view as FIG. 5, FIG. 6 demonstrates the result of the movement of actuator 30 toward container 11. Fitting 36 moves down over valve 14 until bottom surface 35 contacts valve 14 and pushes it toward container 11, thereby opening valve 14 and releasing contents 39. Contents 39 are forced under pressure out open valve 14 through aperture 37 then out through nozzle orifice 33

FIG. 7 demonstrates the closing of valve 14. When pressure on actuator 30 is released, upward pressure of contents 39 forces actuator 30 away from container 11 along guide rails 26 until actuator 30 contacts knobs 24 where its upward movement is stopped. Thus, actuator 30 is held in place by the upward pressure of pressurized contents 39 and the downward restraints of knobs 24. In the preferred embodiment discussed above, a close fitting of actuator 30 within inner wall 21 further stabilizes actuator 30.

FIG. 8 is a top view of actuator 30 and knobs 24 taken along line 8—8 of FIG. 5. Knobs 24 can be seen attached to inner surface 21*a* of wall 21. In one embodiment, knob 24 may be integral with inner surface 21*a* such as may be made with an injecting molding or blow molding process. FIG. 9 is a side section taken along line 9—9 of FIG. 8 through guide rail 26. Guide rail 26 is seen extending from knob 24 along inner surface 21*a*. The shaded portion depicts one side of slot 34 of actuator 30 extending toward inner surface 21*a* along guide rail 26. Gaps 34*a* seen in FIG. 8 demonstrate that slots 34 are close to but, preferably, not in continuous contact with guide rails 26 to enable smooth movement of actuator 30. FIG. 10 is a length-wise section taken along line 10—10 in FIG. 9 clearly showing slot 34 in close proximity to guide rail 26.

FIG. 11 is a top perspective view of a preferred embodiment of the instant invention. Flip cover 40 is shown covering actuator 30 (not shown). Upper surface 41 of flip cover 40 is also seen.

FIG. 12 is cut-away side view of actuator assembly 12 to include flip cover 40. FIG. 12 shows flip cover 40 in the closed position covering actuator 30. Flip cover 40 is attached to collar 20 by insertion of rod 22*a* extending from collar 20 into holes on either side of flip cover 40 to form a hinged attachment. In an alternate embodiment, stems extending from cover 40 may be inserted into receiver 22 to form a hinged attachment. In a preferred embodiment, shoulder stop 23 is shown as an extension of receiver 22. As discussed below, shoulder 23 is configured to restrict the range of motion of flip cover 40 to prevent flip cover 40 from rotating open so far as to hang down in front of nozzle opening 33. FIG. 13 shows flip cover 40 in the open position allowing easy access to actuator 30 by an operator. Persons skilled in the art will recognize that other methods may be used to movably attach flip cover 40 to collar 20 to allow access to actuator 30 when desired by an operator.

FIGS. 14 and 15 illustrate a preferred embodiment in which shoulder 23 prevents flip cover 40 from opening so far as to hang in front of nozzle opening 33. Flip cover 40 includes shoulders 41*a* and 41*b*. As seen in FIG. 14, flip cover 40 is in the closed position with gap 42 between shoulder stop 23 and shoulder 41*a*. Shoulder 41*b* is seen in contact with or in close proximity to shoulder stop 23. When flip cover 40 is opened, as seen in FIG. 15, shoulder 41*a* is rotated until it is stopped by contacting shoulder stop 23. At the same time, shoulder 41*b* rotates away from shoulder 23 to form gap 43. Person skilled in the art will recognize that other designs methods may be used to restrict the movement of flip cover 40.

Thus it is seen that the objects of the invention are efficiently obtained, although changes and modifications to the invention should be readily apparent to those having ordinary skill in the art, which changes would not depart from the spirit and scope of the invention as claimed.

The invention claimed is:

1. An actuator assembly for an aerosol container comprising:

a collar having attachment means for attachment of said collar to said aerosol container, said aerosol container having an aerosol valve and said collar having an inner surface;

a plurality of guide rails projecting from said interior surface of said collar, each of said guide rails having an end proximate to said aerosol container and an end distal to said aerosol container, wherein at least one of said plurality of guide rails is positioned on a different side of said interior surface than the other of said plurality of guide rails;

one or more knobs projecting from said interior surface of said collar;

an actuator positioned below said one or more knobs and comprising at least one slot, said at least one slot in operative contact with one of said guide rails, and including a passage having a first opening and a second opening, said first opening in functional connection with an aerosol valve on said aerosol can; and, a flip cover operatively connected to said collar.

2. The actuator assembly as recited in claim 1 wherein said actuator assembly further comprises at least one stop device configured to stop the rotational movement of said flip cover.

3. The actuator assembly as recited in claim 2 wherein said at least one stop device is a shoulder stop.

4. The actuator as recited in claim 3 wherein said flip cover comprises two shoulders.

5. The actuator assembly as recited in claim 1 wherein one of said at least one knob is positioned on the distal end of at least one of said plurality of guide rails.

6. The actuator assembly as recited in claim 1 wherein one of said at least one knob is positioned on the distal end of each guide rail.

7. The actuator assembly as recited in claim 1 wherein said second end of said passage is a nozzle from which the contents of said aerosol container are released.

8. The actuator assembly as recited in claim 1 wherein said second end is positioned at an angle in the range of about 7–10 degrees from horizontal.

9. The actuator assembly as recited in claim 7 wherein said contents are released up at an angle in the range of about 7–10 degrees from horizontal.

10. The actuator assembly as recited in claim 7 wherein said second end is bell-shaped.

11. The actuator assembly as recited in claim 7 wherein said second end is tapered.

12. The actuator assembly as recited in claim 7 comprising two or more pairs of guide rails.

13. The actuator assembly as recited in claim 1 wherein said functional connection comprises the movement of said actuator and said aerosol valve on substantially coincident axis.

14. The actuator assembly as recited in claim 13 wherein said substantially coincident axes are in a vertical direction.

15. The actuator assembly as recited in claim 1 wherein said functional connection comprises a friction fit between said first end of said passage and said aerosol valve.

16. The actuator assembly as recited in claim 1 wherein said functional connection comprises an attachment between said first end of said passage and said aerosol valve.

* * * * *